United States Patent [19]

Strudel

[11] Patent Number: 4,885,826

[45] Date of Patent: Dec. 12, 1989

[54] EXTERNALLY HELD EXPANDER FOR TUBULAR TEXTILE FABRIC

[75] Inventor: Werner Strudel, Friedrichshafen, Fed. Rep. of Germany

[73] Assignee: Lindauer Dornier Gesellschaft mbH, Lindau, Fed. Rep. of Germany

[21] Appl. No.: 251,501

[22] Filed: Sep. 29, 1988

[30] Foreign Application Priority Data

Sep. 29, 1987 [DE] Fed. Rep. of Germany ..... 3732754

[51] Int. Cl.[4] ..... D06C 3/00

[52] U.S. Cl. ..... 26/80

[58] Field of Search ..... 26/80, 82, 83, 84, 85

[56] References Cited

U.S. PATENT DOCUMENTS

| | | | |
|---|---|---|---|
| 3,370,116 | 2/1968 | Wrede | 26/84 |
| 4,269,046 | 5/1981 | Strahm | 26/85 |
| 4,306,340 | 12/1981 | Strudel | 26/85 |
| 4,306,341 | 12/1981 | Rottensteiner | 26/85 |
| 4,337,630 | 7/1982 | Strahm | 26/85 |

FOREIGN PATENT DOCUMENTS

| | | | |
|---|---|---|---|
| 2848409 | 4/1980 | Fed. Rep. of Germany . | |
| 2926117 | 3/1981 | Fed. Rep. of Germany . | |
| 2143261 | 2/1985 | United Kingdom | 26/80 |

*Primary Examiner*—Werner H. Schroeder
*Assistant Examiner*—Jodi A. Tokar
*Attorney, Agent, or Firm*—W. G. Fasse; D. H. Kane, Jr.

[57] ABSTRACT

A spreader for tubular fabric has a divided central carrier to which struts or support arms are pivoted for carrying longitudinal guide rods, e.g., in parallelogram type fashion. The two sections of the central spreader carrier telescope relative to each other against the force of a spring which presses the two sections of the spreader against upper and lower sets of position determining roller pairs. Support rollers are inserted between the positioning determining roller sets at the upper and lower ends of the spreader. The operation or action of the struts or support arms enables the adjustment of the spreader even in its working position while fabric is running over the spreader. This is possible by changing the axial length of the spreader by an externally arranged lifting mehcanism for raising and lowering at least one of the position determining roller sets. Raising one roller set decreases the spreader diameter while lowering at least one roller set increases the spreader diameter.

20 Claims, 4 Drawing Sheets

EXTERNALLY HELD EXPANDER FOR TUBULAR TEXTILE FABRIC

FIELD OF THE INVENTION

The invention relates to an externally held expander for tubular textile fabric, especially a circular or substantially circular expander.

DESCRIPTION OF THE PRIOR ART

Such expanders have a central carrier for holding several radially expandable support members distributed about the circumference of the spreader. Longitudinal guide elements cooperate with the support members. These guide elements extend at the ends of the support members in the advance direction of the tubular fabric.

Different types of such spreaders are known in the art. For example, the above mentioned longitudinal guide elements extending in the direction of travel of the fabric are outwardly expandable or displaceable, whereby these guide elements bear from the inside out against the inner surface of the tubular fabric for spreading and tensioning the fabric. Another frequent type of spreader is of relatively flat construction comprising two outwardly spreadable or expandable parallel runners or skids over which the tubular fabric is drawn. Counter rollers contact the outside surface of the fabric in recesses of the spreader, whereby the spreader is maintained in a floating state. These flat spreaders, however, have the disadvantage that the narrow skids or runners, or even rollers, and the outwardly located counter rollers damage the fabric due to the required contact pressure on the wet tubular fabric. The damage is noticed in the form of stripes which substantially impair the appearance of the goods.

German Patent (DE-PS) No. 2,848,409 describes another type of spreader, namely a so-called circular spreader, which is expandable in a cylindrical manner. Such a circular spreader for textile tubular fabrics comprises a central carrier carrying radially adjustable spreadable supports and segment type guide elements carried by these supports. The adjustment of the supports and thus of the guide elements takes place by means of bushings adjustable along the length of the central carrier.

In order to keep the tubular textile fabric under tension during the operation, the diameter of the circular spreader must be adapted to the size of the tubular fabric that is to be treated. For this purpose, the above mentioned German Patent Publication discloses a simple embodiment in which the expanding of the spreader is manually adjustable. The adjustment is accomplished by providing the central carrier with upper and lower opposed threads cooperating with threaded bushings in such a way that by rotating the central carrier, the threaded bushings either move toward each other or away from each other, depending on the direction of rotation of the central carrier. The threaded bushings are connected to the longitudinally extending guide elements of the spreader by movably supported brackets extending radially outwardly toward the longitudinal guide elements. When the central carrier is rotated, the threaded bushings are displaced, whereby the guide elements are moved more or less radially outwardly or radially inwardly so that the spreader is widened or contracted. The central carrier is rotated manually in the above mentioned German Patent Publication by means of hand wheels which are arranged at the end of tapering run-in bodies and run-out bodies respectively. However, the hand wheels for adjusting the spreader are easy to rotate only if a tubular fabric has not yet been pulled over the spreader. Thus, the adaptation of the size of the spreader must be accomplished substantially before the spreader is introduced into the tubular fabric. This impairs a smooth continuous operation. German Patent (DE-PS) No. 2,926,117 discloses an arrangement in which the expansion of the circular spreader is possible even when the spreader is inside a tubular fabric. For this purpose the adjustable threaded bushings are coupled to pneumatic drive means provided inside the circular spreader. The compressed air connecting junctions are arranged recessed in the guide elements of the spreader and the respective coupling element is provided with a nonreturn valve. The required pressurized air is easily supplied through a hose piece that can be coupled to an outwardly positioned coupling. Since the pressurized air can be supplied through the fabric to the coupling at the guide element of the spreader, it is possible at all times to cause an adjustment of the spreader from the outside. Another embodiment also described in German Patent Publication (DE-PS) No. 2,926,117 provides for a cooperation of the above mentioned threaded bushings with the central carrier in such a manner that a radial magnet is rigidly connected with the central carrier. The radial magnet has radially outwardly located strong magnetic poles which cooperate with external magnets for rotating the central carrier.

All of the above mentioned devices, however, have the disadvantage that the drive elements for the spreading or narrowing of the circular spreader are located inside the spreader so that they must be influenced from the outside through the tubular fabric. In order to bring the circular spreader into the proper spread out position, it is necessary that the spreading or narrowing is monitored and controlled from the outside. A fully automatic adjustment of the spreader is not possible in the prior art.

OBJECTS OF THE INVENTION

In view of the foregoing it is the aim of the invention to achieve the following objects singly or in combination:

to modify cylindrical circular spreaders for tubular textile fabrics in such a way that their advantages are maintained while their disadvantages are avoided;

to construct such a spreader in such a way that an adaptation of the external spreader diameter to the required diameter for the particular textile fabric can be accomplished externally, and if needed, even when a tubular fabric is running over the spreader;

to provide such a spreader with a telescoping type of axial adjustment which spreads or contracts the spreader; and to provide axially effective locking means to maintain the spreader in an adjusted position by making the telescoping means ineffective after adjustment.

SUMMARY OF THE INVENTION

According to the invention the circular spreader for tubular fabric is characterized by the following features. The central carrier of the spreader is divided into two sections which are displaceable relative to each other in the longitudinal direction against a biasing spring force.

Struts or support arms are pivoted to the respective central carrier sections. These struts or arms are capable of being spread out and connect the respective central section to longitudinal guide elements of the spreader. The struts or arms of one carrier section are inclined in one direction while the struts or arms of the other carrier section are inclined in the opposite direction. Each end of the spreader is equipped with a pair of support rollers which are biased by the above mentioned spring force outwardly in the longitudinal axial direction to bear against a pair of positioning rollers arranged outside the tubular fabric, whereby the spreader is clamped in position between the positioning rollers, which thus fix the position of the spreader within the path of the fabric. At least one pair of positioning rollers is supported by a position adjusting device capable of changing or adjusting the position of the positioning rollers against the above mentioned axially effective biasing spring force.

Thus, the essential teaching of the invention as compared to the prior art, is seen in that the invention does not use a rigid central carrier equipped with longitudinally adjustable threaded bushings for expanding the longitudinal elements of the spreader to increase its outer diameter. Instead, the invention uses two central carrier sections, each having, e.g., a tubular carrier member, which are displaceable relative to each other in a telescoping manner. For example, these tubular carrier members may be displaceable relative to a common guide element relative to which the tubular carrier members can telescope. The guide element is straight and coaxial.

The radially spreadable or expandable struts or support arms are pivoted on their inner ends to the central tubular carrier member and at their outer ends to the longitudinal guide elements, whereby the central guide element and the outer longitudinal guide elements are connected to each other in a movable manner due to the pivoting. The longitudinal guide elements of the spreader which form the spreader's circumference, are provided in common for both spreader sections. Thus, a plurality of strut elements lead from the central tubular carrier member to the outer longitudinal guide elements, whereby pairs of struts may form guide parallelograms together with the respective outer longitudinal guide element and the corresponding tubular central carrier member. This parallelogram type arrangement is preferably provided in at least one carrier section. A single set of struts arranged in a single plane in the other carrier section may be sufficient for the purpose of radially spreading the longitudinal guide elements while still assuring that the longitudinal guide elements are always oriented exactly in parallel to one another. As mentioned, the struts in one carrier section are inclined, for example, downwardly while the struts in the other carrier section are inclined in the opposite direction, for example, upwardly as viewed from the central longitudinal axis. Thus, when the inner ends of the struts are displaced axially, that is when the carrier sections are displaced axially relative to each other, the struts either spread the longitudinal guide elements radially outwardly when the carrier sections approach each other, thereby increasing the outer diameter of the spreader, or when the carrier sections are axially moved away from each other, the longitudinal guide elements are drawn in radially, thereby reducing the outer diameter of the spreader. This diameter adjustment can be made automatically even while fabric is running over the spreader. The adjustment can be made externally without the need for any adjustment forces effective through the fabric.

Due to the above mentioned spring biasing force which is effective in the longitudinal axis of the spreader, the spreader sections tend to move axially away from each other, whereby the support rollers at the end of the spreader bear against the external positioning rollers which are mounted in the machine frame and bear on the outer surface of the tubular textile fabric to be treated. As mentioned, at least one set of the position determining rollers is mounted on a position adjustable device so that the respective set of positioning rollers can be displaced in the longitudinal axial direction and then fixed in any desired position, depending on the required outer diameter of the spreader. As a result, the spreader diameter can be adjusted from the outside by changing the axial spacing between the positioning roller pairs. Such change causes the above mentioned telescope type lengthening or shortening of the carrier. This axial displacement of the upper and/or lower carrier sections relative to each other has the further advantage that the adjustment can be made independently of any instantaneous operating condition of the apparatus. That is, even while fabric is running over the spreader its diameter can be adjusted. It has been found to be advantageous when the support roller pairs at the upper and lower end of the spreader are arranged on spreader support heads at least one of which is rotatable about the longitudinal axis of the central tubular carrier sections. This feature enables the spreader to rotate unhindered about its own longitudinal axis during the operation of the apparatus. This feature is advantageous, for example, when treating tubular textile fabric having a tendency to twist about its longitudinal axis.

According to a further embodiment of the invention the lower carrier section is inserted into a tubular type axial recess of a float body. The respective spreader head with its support roller pair is then arranged at the lower end of the float body in such a way that the lower spreader head is rotatable about the longitudinal axis relative to the float body. However, it is also possible that the lower spreader head and the float body permit rotation of the remainder of the spreader relative to the float body and lower spreader head.

When the spreader with a float body is inserted into a liquid bath in a treatment chamber for the tubular fabric, the float body dips into the liquid and its buoyancy reduces the forces bearing onto the lower support roller pair. Depending on the diameter of the spreader required during operation, the float bodies may be constructed to be exchangeable so that several float bodies of different sizes or shapes can be kept on hand for use in the treatment of different types and sizes of tubular fabrics. For example, a cylindrical float body having a diameter corresponding approximately to that of the spreader is suitable for a spreader having the smallest possible outer diameter. Where spreaders with a larger outer operating diameter are needed the float body may have a frustum shaped configuration. The lower end or smaller diameter end of the frustum rests on the spreader head and corresponds approximately to the smallest diameter of the spreader. The upper larger diameter of the frustum corresponds approximately to the adjusted diameter of the circular spreader.

According to the invention devices are provided for locking the upper and lower spreader sections against further axial displacement relative to each other when the desired or the maximum spreader diameter has been adjusted, whereby the spreader diameter may be fixed for a particular run of fabric. A suspending bracket is provided in order to suspend the spreader with its now fixed largest diameter from the position adjustable mechanism for the upper positioning roller pair. By simply raising the spreader when it is suspended from its upper support, by lifting the position adjusting mechanism, the lower spreader section can be lifted out of the float body. Thus, a rapid exchange of one float body for another type of float body is easily possible.

The lifting mechanism for adjusting the axial spacing between the position defining rollers may be realized by different means. For example, a mechanical or pneumatic or hydraulic drive may be used for the lifting or lowering of at least one position defining roller pair. The type of construction of the lifting mechanism is not important to the invention. However, it is important that the position defining rollers, for example, of the upper roller pair, can be displaced up or down exactly in parallel or rather coaxially to the central longitudinal axis of the spreader. Once the position of the position defining rollers is established, it must be assured that they retain this position until another adjustment is made. The same considerations apply if the lower position defining pair of rollers is axially adjustable. Both position defining rollers pairs may be adjustable.

The type of transport mechanism and the direction of transport of the tubular fabric to be treated is not important to the invention. The tubular fabric may travel up or down through the treatment chamber without affecting the function and adjustability of the present spreader.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
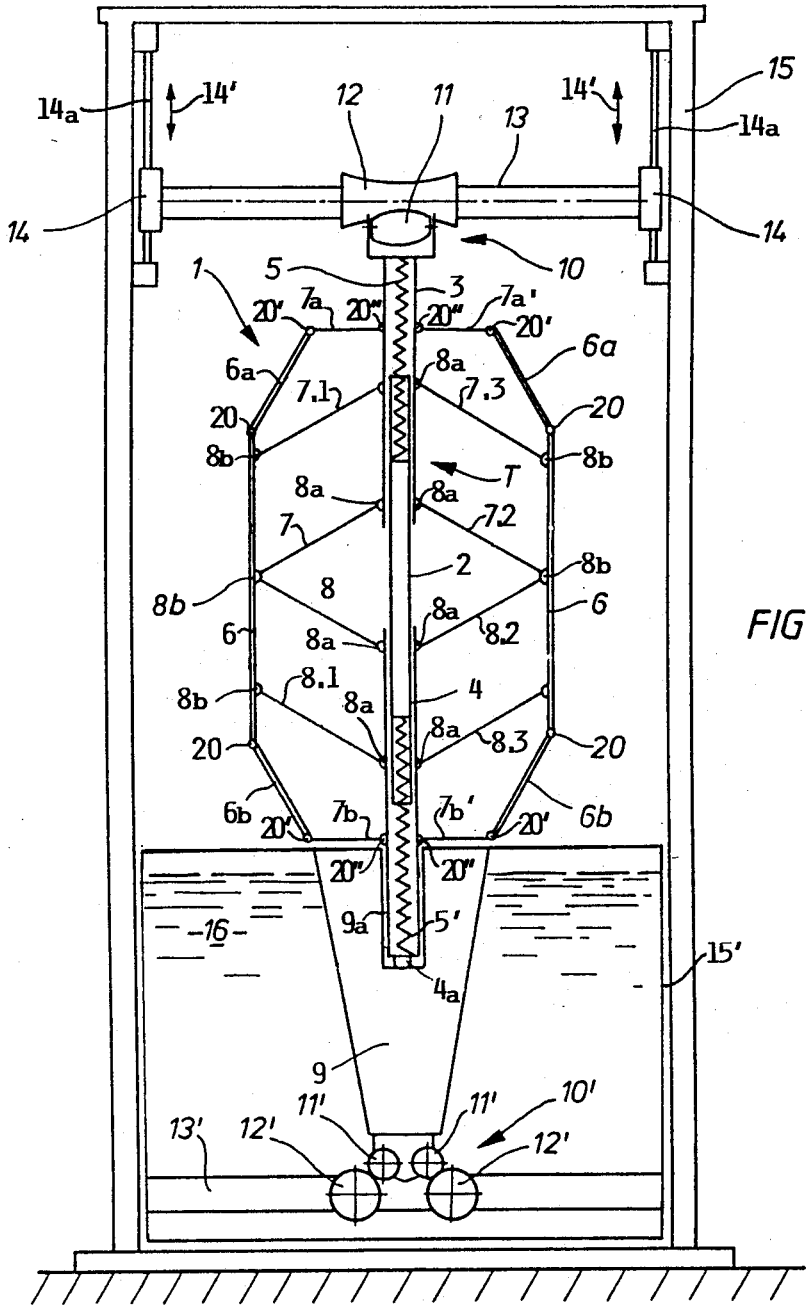
FIG. 1 is a schematic side view of a spreader according to the invention shown in a treatment housing or chamber.
Figure 3:
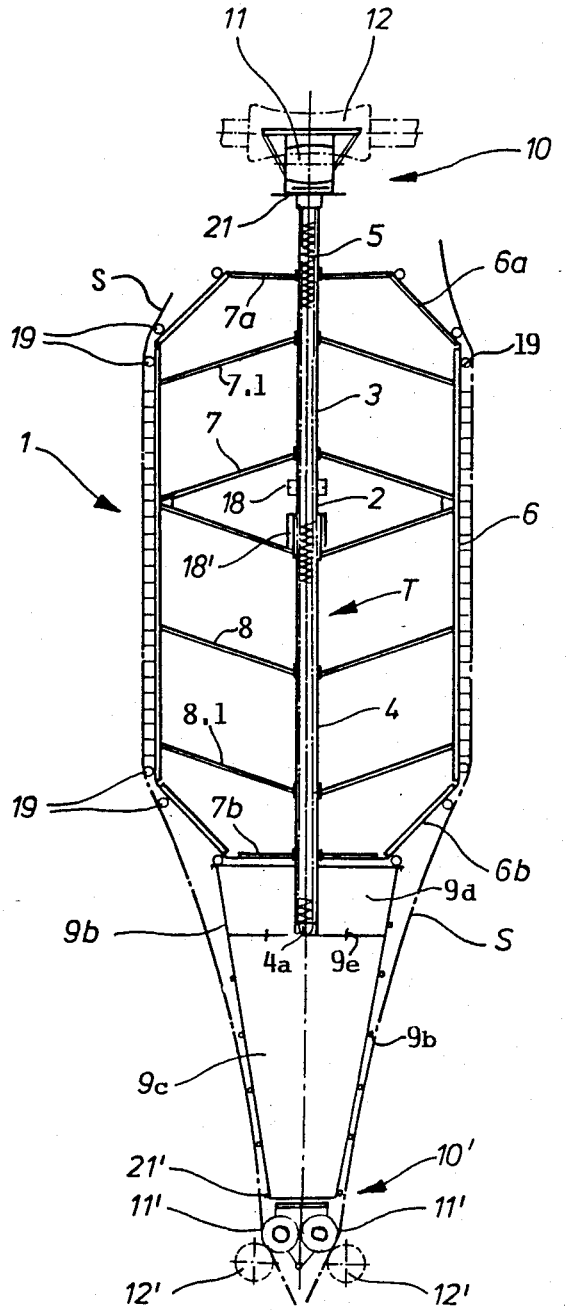
FIG. 3 is a view similar to that of FIG. 1 showing the spreader in its expanded state and illustrating the position of the fabric as well as a modified float body.

FIG. 1 shows in a much simplified manner a treatment unit for tubular textile fabric S shown in FIG. 3. The treatment unit comprises a housing or frame 15, the lower end of which is itself constructed as a container 15' for holding a liquid bath 16. A position adjustable cross beam 13 is supported in the machine frame by means, for example, of spindle nuts 14 capable of riding up and down along spindles **14*a* as indicated by double arrows 14'. Rotating the spindles 14*a* by conventional drive means causes the up and down movement of the cross beam 13 which actually may be constructed as a cross frame. An upper position defining pair of rollers 12 is rotatably supported by the cross beam or frame 13. Although a spindle drive has been shown for the adjustment of the cross beam or frame 13, piston cylinder devices or the like may also be employed for this up and down adjustment. In any event, the respective drive is controllable from the outside of the treatment unit so that the diameter of the spreader 1 can be adjusted without applying any forces through the fabric. A lower position defining pair of rollers 12' is rotatably supported on a cross beam or frame 13' which may be held in a fixed position or which may also be vertically adjustable up or down by the same means as described above for the upper cross beam or frame 13. The position of the spreader 1 in the treatment unit is defined by the vertical spacing between the position determining rollers 12 and 12'. The spreader 1 has a central carrier 2 which is divided into an upper carrier section in the form of a tubular member 3 and into a lower section in the form of a further tubular member 4. An intermediate guide section 2 which may also be a tubular member or a solid rod fits into the open ends of the tubular members 3 and 4 to form a telescoping device, the members of which are axially biased away from each other by at least one, preferably two, springs 5 and 5'. These springs are received in the respective tubular members. The springs are so dimensioned and formed that they tend to stretch the spreader 1 in the longitudinal axial direction, whereby an upper spreader head 10 with its support rollers 11 is pressed against the position defining rollers 12 while a lower spreader head 10' with its support rollers 11' is pressed against the position defining rollers 12'. Thus, if the cross beam or frame 13 and/or the cross beam or frame 13' are adjusted vertically up and down, the springs 5 and 5' will react accordingly, thereby contracting or expanding the spreader 1 respectively. The support rollers 11, 11' have an outwardly bulging convex configuration while the respective positioning rollers 12** have an inwardly bulging concave configuration or rather surface.

As best seen in FIG. 3, the tubular fabric S passes between the support rollers 11, 11' on the one hand and the positioning defining rollers 12, 12' on the other hand. Thus, the support rollers 11, 11' are located inside the fabric while the position defining rollers 12, 12' are located outside the fabric. The upper end of FIG. 3 does not show the details of the guiding of the fabric S since that is not part of the invention.

Referring further to FIG. 1, the lower spreader head 10' is not directly supporting the lower end of the carrier section 4. This is possible, however, whereby the lower end of the carrier section or tubular member 4 would directly rest on the spreader head 10' as is the case of the upper end of the tubular member 3 bearing against the upper spreader head 10. In FIG. 1, the lower end of the tubular member 4 is received in a hole **9*a* of a float body 9. This float body 9 is conventionally immersed in the bath 16, thereby reducing the bearing forces between the support rollers 11' and the respective positioning rollers 12'. This feature has the further advantage that the pressure exerted by the roller pairs on the tubular fabric passing through between the roller pairs is reduced. The hole 9*a* in the float body 9 permits an easy insertion of the lower end of the tubular member 4, which preferably rests, for example, through a rubber pad 4*a* on the bottom of the hole 9*a*. The rubber pad provides an elastic type of bearing between the float body 9 and the tubular member 4. The two springs 5 and 5' could be replaced by a single spring passing all the way from the lower spreader head 10' to the upper spreader head 10 provided that the central guide member 2** is a tubular member through which the spring can extend.

The upper section of the central carrier T comprises a plurality of struts or support arms connecting the upper tubular member 3 to the longitudinal guide support elements 6. More specifically, struts 7, 7.1, 7.2, and 7.3 are connected with their radially inner ends by pivot joints 8*a* to the tubular member 3. The radially outer ends of these struts are connected by pivot joints 8*b* to the vertical guide rods 6. Further shorter struts 7*a* and 7*a*′ connect the tubular member 3 through pivot joints to shorter guide rods 6*a* which in turn are pivoted by pivot joints 20 to the vertical guide rods 6. A plurality of strut pairs may be uniformly distributed around the tubular member 3, whereby the strut pairs lead to respective vertical guide rods 6 distributed around the circumference of the spreader T in a polygonal fashion. For example, eight sets of struts and eight guide rods 6, 6*a* would form a spreader T having an octagonal configuration in its cross-section.

Similarly, the lower section of the spreader 1 is connected with its tubular member 4 to the guide rods 6 and 6*b*, whereby the struts 8, 8.1, 8.2, and 8.3 are connected in the same manner as described above with respective pivot joints 8*a* and 8*b*. The lower slanted guide rods 6*b* are pivoted at 20 to the vertical guide rods 6 and at 20′ to the shorter struts 7*b* and 7*b*′. The struts 7*b* and 7*b*′ are connected to the lower tubular member 4 by pivot joints 20″. Similarly, the short struts 7*a* and 7*a*′ are connected by respective pivot joints 20″ to the tubular member 3. The longer struts or support arms of the upper spreader section slant downwardly relative to the longitudinal central axis of the spreader. The longer struts of the lower spreader section slant upwardly relative to the central longitudinal axis. The shorter struts extend substantially horizontally in the position shown in FIG. 1. Thus, pairs of struts such as 7 and 7.1 or 8 and 8.1 form guide parallelograms together with the respective portion of the tubular members 3 and 4 and the guide rods 6. In all embodiments, the axial spacing between the inner tubular members 3 and 4 will determine the diameter of the spreader. This spacing can be increased by moving the positioning rollers 12 upwardly, whereby the diameter is reduced.

Similarly, when the spacing is decreased by moving the positioning rollers 12 downwardly, the diameter is increased. This feature of the invention has the advantage that the diameter of the spreader 1 can be adjusted while the treatment unit is in operation.

Due to the arrangement of the slanting guide rod elements 6*a* and 6*b*, with their pivot joints, the conical end portions of the spreader are formed at the lower end and at the upper end, whereby damage to the tubular fabric is avoided since it is spread gradually from the smaller inlet diameter to the full diameter as determined by the position of the guide rods 6. Similarly, as the fabric leaves the spreader, the upper conical end also gradually reduces the diameter. Incidentally it is, in this connection, assumed that the fabric moves vertically upwardly. However, the fabric may also move vertically downwardly. In both instances the conical end portions of the spreader provide a smooth transition between the spreader head 10′ and the lower end of the spreader and the upper end of the spreader and the spreader head 10.

The upper end of the float body 9 has a diameter approximately corresponding to the diameter determined by the struts 7*b* and 7*b*′ as seen in FIG. 1. The float body 9 tapers downwardly so that its lower end has a diameter approximately equal to that of the spreader head 10′. Preferably, and advantageously, the lower end diameter of the float body 9 and of the spreader head 10′ correspond to the minimum diameter of the spreader.

Figure 2:
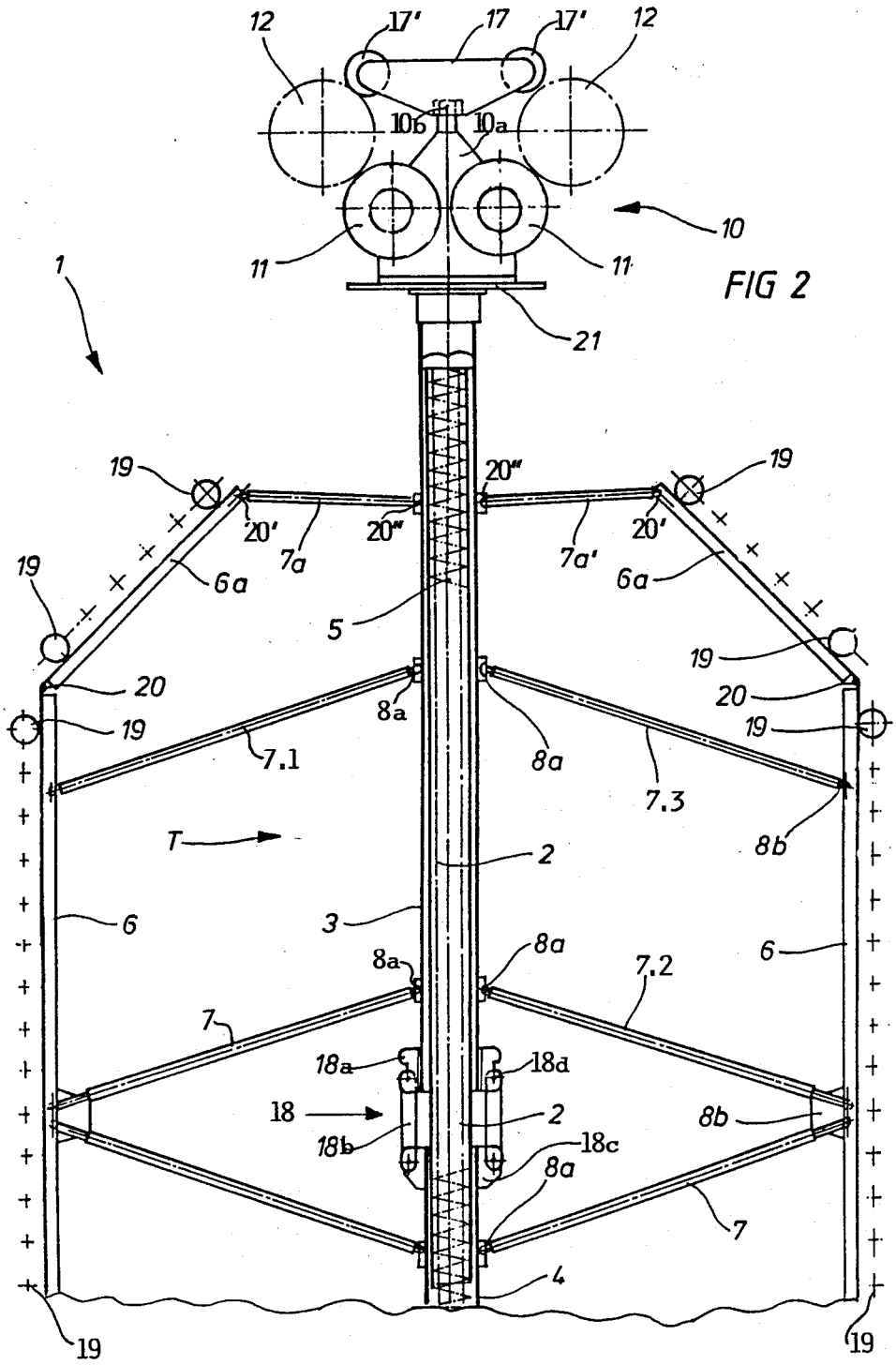
FIG. 2 is a view similar to that of FIG. 1, but showing the upper section of the present spreader on an enlarged scale including a locking device.

In FIG. 2 the upper portion of the spreader 1 including its central carrier T are shown on an enlarged scale, whereby the telescoping or guiding of the tubular carrier member 3 is accomplished by the straight guide member 2. Here the spring 5 extends entirely through the tubular members 2, 3, and 4. The arrangement of the struts with their pivot joints and the arrangement of the longitudinal guide rods 6, 6*a* is the same as described above with reference to FIG. 1. Guide rollers 19 are arranged along the longitudinal guide rods 6 and 6*a*. However, only four guide rollers 19 are shown, whereas the other guide rollers are merely indicated by little crosses for simplicity's sake. These guide rollers facilitate the riding of the tubular fabric along the guide rods and assure a gentler handling of the fabric. The outer diameter D is determined by the guide rollers 19.

FIG. 2 also shows the suspension of the spreader 1 from the upper positioning rollers 12. For this purpose, the upper spreader head 10 on which the support rollers 11 are mounted, has a suspension bracket 10*a*, the lower end of which rests on a bearing 21 permitting the spreader 1 to rotate relative to the bracket 10*a*. The upper end of the bracket 10*a* is secured, for example, by a nut and bolt 10*b* to a suspension carriage 17 having rollers 17′ resting and rolling on the positioning rollers 12. The bearing 21 is a conventional turntable type of bearing and hence not described in detail. The suspension carriage 17 holds the entire spreader 1, for example, on the cross beam 13 of the position adjustment and lifting mechanism 14. As shown, the rollers 17′ bear sufficiently against the positioning rollers 12 so as to be able to suspend the entire spreader 1. In this embodiment it is also possible to exchange the float body 9, not shown in FIG. 2, by lowering the positioning rollers 12 so that the spreader assumes its maximum diameter D. In this position the upper tubular member 3 and the lower tubular member 4 are close enough together for locking the two to each other by the locking mechanism 18 which has an upper locking bushing 18*a* secured to the lower free end of the tubular member 3 and a lower locking bushing 18*c* secured to the upper free end of the tubular member 4. The two bushings are interconnectable by locking brackets 18*b* having pins 18*d* latching into recesses of the upper locking bushing 18*a*. The action of the spring 5 keeps the locking pins 18*d* engaged. Unlocking is accomplished by pushing the two spreader sections slightly toward each other. As long as the two spreader sections are locked to each other, the spreader will maintain its shortest length.

When the spreader 1 is in its locked condition, it is inserted with the carriage 17 by aligning the length of the carriage 17 approximately in parallel to the longitudinal axes of the positioning rollers 12 and passing the carriage 17 through between the rollers 12 and then turning the carriage until the rollers 17′ rest on the rollers 12. Then the lifting mechanism 14 is operated until the lower free end of the tubular member 4 clears the top surface of the float body 9. Now, the float body 9 can be exchanged against another suitable float body, for example, shown at 9′ in FIG. 4. The exchange is accomplished rapidly and easily without any problems.

Thereafter, the lifting mechanism 14 is operated to lower the spreader until the central carrier T and the longitudinal spring 5 are again clamped in place between the two spreader heads 10 and 10' to such an extent that the locking mechanism 18 can easily be released.

If necessary, the suspension carriage 17 may be removed for this purpose, or at least turned so that it could pass through the position rollers 12. Thereafter, and with the carriage 17 in the position shown in FIG. 2, the lifting mechanism 14 can again be raised for adjusting the spreader 1 to the desired diameter.

FIG. 3 shows an embodiment of the spreader according to the invention, having a longer lower section and a shorter upper section. The upper section has two sets of long struts and one set of short struts. The lower section has three sets of long struts and one set of short struts. The rollers 19 are also shown in FIG. 3 for guiding the fabric along the outer surface of the longitudinal guide rods 6. Additionally, FIG. 3 has a somewhat longer, more slender float body 9c having an upper section 9d that may be secured to the lower section, for example by pins 9e. The float body 9c and 9d has circumferential rings 9b of narrow cross-section for reducing the contact surface between the float body and the fabric S. FIG. 3 also shows a lower turntable type of bearing 21' of conventional construction in addition to the turntable type of bearing 21 at the upper end. Thus, the spreader of FIG. 3 is completely free to rotate about its longitudinal axis and relative to the position determining roller sets 12 and 12'. The locking mechanism 18 is shown in its open condition in FIG. 3. The function and adjustability of the embodiment of FIG. 3 is the same as has been described above with reference to the embodiments of FIGS. 1 and 2.

Figure 4:
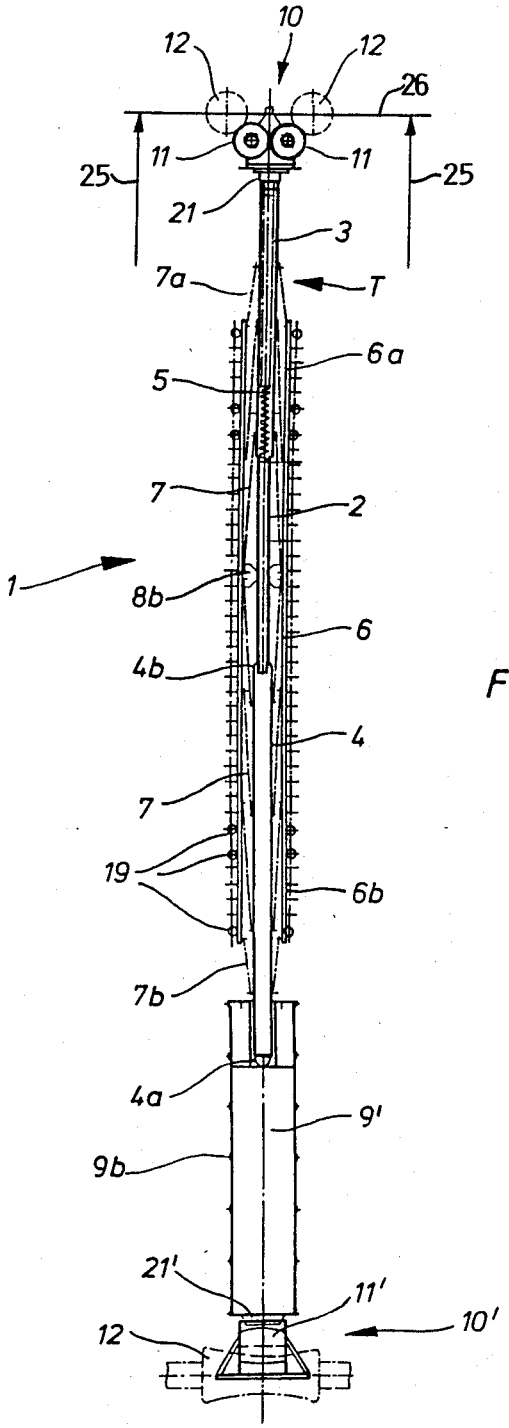
FIG. 4 shows the spreader in its most contracted condition with a respectively adapted float body of a relatively small diameter or cross-sectional size.

FIG. 4 shows the spreader 1 in a fully contracted condition with the lifting mechanism 14 raised to its uppermost position, whereby the spreader diameter is minimal, whereby the longitudinal guide elements 6 and their extensions 6a and 6b are closely spaced from the central carrier tubular members 3 and 4. The circumferential spacing between the longitudinal guide elements is also smallest in this condition. The strut elements extend at a very acute angle relative to the longitudinal central axis. In this condition the spreader 1 cooperates with a different float body 9' having, for example, a square cross-sectional configuration and still carrying rings 9b for properly guiding the fabric S and reducing the contact area between the fabric and the float body 9'. The float body 9' has the same diameter or cross-sectional configuration at both ends. Guide rollers 19 may be provided as described above. Arrows 25 stopping against a horizontal line 26 indicate schematically that the spreader 1 is elastically spread-out as much as possible, but still properly held in place by the force of the longitudinal spring 5 between the upper position determining roller pair 12 and the lower position determining roller pair 12'.

Further, in FIG. 4 it is shown that the upper end 4b of the tubular member 4 is rigidly secured to the central guide tubular member 2 so that the telescoping action takes place between the upper free end of the guide tubular member 2 and the upper tubular member 3. In this embodiment the central guide member 2 may be a solid rod welded to the upper end of the lower tubular member 4. The spring 5 may be provided just between the upper tubular member 3 and the upper end of the guide member 2. If desired, the spring 5 could surround the guide member 2 and rest with its lower end against the upper end 4b of the tubular member 4. The spring 5 could, alternatively surround all three members 2, 3, 4 and extend from one end of the central carrier T to the other end thereof.

Incidentally, the rings 9b also shown in FIG. 4 reduce the friction between the fabric and the float body 9' as they do in FIG. 3. This is particularly advantageous when the fabric S is wet.

As shown in the drawings, the slanted longer struts or support arms are arranged in two or even three tiers in each carrier or spreader section. The shorter radially extending struts are arranged in one tier in each section. It would be sufficient, however, to arrange the longer struts also only in one tier in each section, depending on the total length of the spreader.

Although the invention has been described with reference to specific example embodiments, it will be appreciated, that it is intended to cover all modifications and equivalents within the scope of the appended claims.

What I claim is:

1. An externally held expander for tubular textile fabric comprising machine frame means, central carrier means having a central longitudinal axis for supporting said expander, said central carrier means including a first carrier section and a second carrier section, means for telescoping said first and second carrier sections relative to each other in the direction of said central longitudinal axis, substantially longitudinally extending guide rods, first strut means for securing said guide rods to said first carrier section, second strut means for securing said guide rods to said second carrier section, first pivot means securing a radially inner end of said first strut means to said first carrier section and a radially outer end of said first strut means to a respective guide rod of said guide rods, second pivot means for securing a radially inner end of said second strut means to said second carrier section and a radially outer end of said second strut means to a respective guide rod of said guide rods, said first strut means being inclined in one direction, said second strut means being inclined in a direction opposite to said one direction, axially effective spring means (5) arranged for cooperation with said first and second carrier section to urge said first and second carrier sections axially away from each other, support roller means at least at one axially outer end of said first and second carrier sections for supporting said central carrier means, position determining roller means mounted in said frame means for cooperation with said support roller means to determine an axial spacing between said first and second carrier sections, said position determining roller means comprising at least one set of rollers that is adjustable in its axial position, and position adjustable mounting means on which said positioning rollers mounted for an axial position adjustment against the force of said spring means in one axial direction and with said spring force opposite axial direction, whereby an axial movement of said rollers permits an adjustment of an effective diameter of said expander by varying said axial spacing between said first and second carrier sections.

2. The expander of claim 1, wherein said support roller means have a profiled surface, said position determining roller means also having a profiled surface matching said first mentioned profiled surface.

3. The expander of claim 1, wherein said longitudinal guide rod means comprise end portions pivoted at one end to a respective guide rod, and means for pivoting said guide rod end portions to a respective carrier section of said central carrier means, said guide rod end portions tilting radially inwardly to form conical spreader ends tapering toward a respective support roller means.

4. The expander of claim 3, wherein said means for pivoting comprise third strut means shorter than said first and second strut means, for pivoting said guide rod end portions to said respective carrier section.

5. The expander of claim 1, wherein each of said first and second carrier sections comprises a telescoping member (3, 4), wherein said means for telescoping comprise a central straight guide member (2) arranged for telescoping with each of its ends relative to one of said telescoping members, said axially effective spring means being arranged between said central straight guide member and said telescoping members, said telescoping members carrying said first and second pivot means for said first and second strut means.

6. The expander of claim 1, wherein each of said first and second carrier sections comprises a straight member, said telescoping means comprising a further central straight guide member (2) rigidly secured to one of said straight members and telescoping relative to the other of said straight members, said straight members carrying said first and second pivot means for said first and second strut means, said axially effective spring means being arranged for cooperation with said central straight guide member and at least one of said straight members.

7. The expander of claim 1, wherein at least one of said first and second strut means comprise pairs of struts forming a parallelogram with a respective guide rod of said guide-rods and with a respective portion of a corresponding carrier section of said first and second carrier sections, said pairs of struts being arranged in at least two cross planes axially spaced from each other, and wherein the respective other of said first and second strut means comprise at least one set of struts arranged in at least one cross plane.

8. The expander of claim 1, further comprising spreader head means (10, 10') for mounting said support roller means at least at one end of said central carrier means.

9. The expander of claim 8, wherein said spreader head means are arranged between an upper end of said central carrier means and the respective positioning determining roller means.

10. The expander of claim 8, wherein said spreader head means are arranged at each end of said central carrier means.

11. The expander of claim 1, further comprising floating means for providing buoyancy when said spreader is inserted in a fabric treatment bath, said central carrier means being arranged vertically and having a lower end removably supported in said floating means, said spreader further comprising a spreader head (10') for mounting a lower end of said floating means to respective support rollers of said support roller means for supporting said spreader in a vertical position.

12. The expander of claim 8, further comprising bearing means operatively arranged between said central carrier means and said spreader head means for permitting rotation of said spreader about said central longitudinal axis.

13. The expander of claim 11, wherein said floating means comprise a central axial hole in which a lower end of one of said carrier sections is received in exchangeable manner.

14. The expander of claim 11, wherein said floating means have a frustum shaped float body having a large end diameter near its respective carrier section.

15. The expander of claim 14, wherein said large end diameter corresponds approximately to the diameter of an end section of said spreader.

16. The expander of claim 11, further comprising guide rollers (19) secured to said longitudinally extending guide rods.

17. The expander of claim 1, further comprising locking means (18) for locking said first and second carrier sections to each other.

18. The expander of claim 17, wherein said locking means are located on said first and second carrier sections in positions for locking said first and second carrier sections to each other when said spreader has its widest diameter.

19. The expander of claim 1, further comprising suspension means (17) for suspending said spreader from said position adjustable mounting means.

20. The expander of claim 19, wherein said suspension means comprise a suspension carriage having suspension rollers arranged for, cooperation with said one set of positioning rollers.

* * * * *

UNITED STATES PATENT AND TRADEMARK OFFICE

CERTIFICATE OF CORRECTION

PATENT NO. : 4,885,826

DATED : December 12, 1989

INVENTOR(S) : Werner Strudel

It is certified that error appears in the above-identified patent and that said Letters Patent is hereby corrected as shown below:

In the Abstract, line 15, replace "mehcanism" by --mechanism--;

In the Claims:

Claim 1, line 32, column 10, line 54, after "set of" insert --positioning--;

line 34, column 10, line 56, after "rollers" insert --are--;

line 36, column 10, line 58, after "spring force" insert --in the--;

line 37, column 10, line 59, after "of said" insert --positioning--;

Claim 13, line 3, column 12, line 22, after "received in" insert --an--;

Claim 20, line 3, column 12, line 46, after "for" delete ",".

Signed and Sealed this

Twenty-third Day of October, 1990

*Attest:*

HARRY F. MANBECK, JR.

*Attesting Officer*

*Commissioner of Patents and Trademarks*